US007001013B2

(12) United States Patent
Lewis et al.

(10) Patent No.: US 7,001,013 B2
(45) Date of Patent: Feb. 21, 2006

(54) NANOSTRUCTURE BASED MICROFLUIDIC PUMPING APPARATUS, METHOD AND PRINTING DEVICE INCLUDING SAME

(75) Inventors: Howard Lewis, Memphis, TN (US); Habib Mohamadinejad, Bartlett, TN (US)

(73) Assignee: Brother International Corporation, NJ (US)

( * ) Notice: Subject to any disclaimer, the term of this patent is extended or adjusted under 35 U.S.C. 154(b) by 0 days.

(21) Appl. No.: 10/316,240

(22) Filed: Dec. 12, 2002

(65) Prior Publication Data

US 2004/0113980 A1 Jun. 17, 2004

(51) Int. Cl.
*B41J 2/045* (2006.01)
*B41J 2/06* (2006.01)

(52) U.S. Cl. ..... 347/68; 347/55

(58) Field of Classification Search ..... 347/54, 347/70, 72, 55, 68; 200/181; 239/4, 102.2, 239/102.1; 310/302; 60/516; 417/413.1, 417/413.2, 410.1
See application file for complete search history.

(56) References Cited

U.S. PATENT DOCUMENTS 3,683,212 A 8/1972 Zoltan
3,747,120 A 7/1973 Stemme
4,126,868 A 11/1978 Kirner
4,216,483 A 8/1980 Kyser et al.
4,877,451 A * 10/1989 Winnik et al. ..... 106/31.45
5,604,522 A 2/1997 Miura et al.
5,772,905 A 6/1998 Chou
5,822,542 A 10/1998 Smith et al.
5,854,902 A 12/1998 Wilson et al.
6,132,278 A 10/2000 Kang et al.
6,154,131 A 11/2000 Jones, II et al.
6,166,763 A 12/2000 Rhodes et al.
6,198,391 B1 3/2001 DeVolpi (Continued)

FOREIGN PATENT DOCUMENTS

JP 02276649 * 3/1989 ..... 29/890.1

(Continued)

OTHER PUBLICATIONS

Ruben, et al. "Pulmonary Function and Metabolic Physiology of Theropod Dinosaurs", Science, Jan. 22, 1999, vol. 283, pp. 14.

(Continued)

*Primary Examiner*—Stephen Meier
*Assistant Examiner*—An H. Do
(74) *Attorney, Agent, or Firm*—Reed Smith LLP

(57) ABSTRACT

A microfluidic actuator suitable for effecting drop on demand inkjet printing by ejecting fluid through at least one nozzle from at least one cavity being at least partially formed by a deflectable membrane, the actuator including: an actuator chamber operatively coupled to the membrane and containing at least on electrolytic fluid; and, at least one nanostructure contained in the electrolytic fluid; and, wherein, the nanostructure is adapted to deflect toward the membrane in response to an operating voltage being applied to at least the nanostructure thereby deflecting the membrane and causing the fluid to be ejected through the nozzle.

69 Claims, 3 Drawing Sheets

U.S. PATENT DOCUMENTS

| | | | | |
|---|---|---|---|---|
| 6,226,031 | B1 | 5/2001 | Barraclough et al. | |
| 6,271,752 | B1 | 8/2001 | Vaios | |
| 6,292,098 | B1 | 9/2001 | Ebata et al. | |
| 6,309,580 | B1 | 10/2001 | Chou | |
| 6,323,897 | B1 | 11/2001 | Kogane et al. | |
| 6,332,671 | B1 * | 12/2001 | Takahashi et al. | 347/68 |
| 6,392,692 | B1 | 5/2002 | Monroe | |
| 6,400,265 | B1 | 6/2002 | Saylor et al. | |
| 6,404,455 | B1 | 6/2002 | Ito et al. | |
| 6,416,471 | B1 | 7/2002 | Kumar et al. | |
| 6,424,370 | B1 | 7/2002 | Courtney | |
| 6,445,006 | B1 | 9/2002 | Brandes et al. | |
| 6,555,945 | B1 * | 4/2003 | Baughman et al. | 310/300 |
| 2002/0180306 | A1 * | 12/2002 | Hunt et al. | 310/302 |
| 2002/0195326 | A1 * | 12/2002 | Hunter et al. | 200/181 |

FOREIGN PATENT DOCUMENTS

WO WO 0177694 A 10/2001

OTHER PUBLICATIONS

Fan et al., "Self-Oriented Regular Arrays of Carbon Nanotubes and Their Field Emission Properties", Science, Jan. 22, 1999, vol. 283, pp. 512-513.

Fan et al., "Self-Oriented Regular Arrays of Carbon Nanotubes and Their Field Emission Properties", Science, Jan. 22, 1999, vol. 283, pp. 512-514.

Ray H. Baughman, et al., "Carbon Nanotube Actuators", Science, May 21, 1999, vol. 284, pp. 1340-1344.

C. Liu, et al., "Volumetric Hydrogen Storage in Single-walled Carbon Nanotubes", 2002 American Institute of Physics, Apr. 1, 2002, vol. 80, No. 13, pp. 2389-2391.

Philip. G. Collins et al., "A Simple and Robust Electron Beam Source from Carbon Nanotubes", 1996 American Institute of Physics, Sep. 23, 1996, Appl. Phys. Lett. 69, No. 13, pp. 1969-1971.

Anyuan Cao, et al., "Growth of Aligned Carbon Nanotubes on Self-Similar Macroscopic Templates", 2002 American Institute of Physics, Aug. 12, 2002, vol. 81, No. 7, pp. 1297-1299.

G.Z. Yue et al., "Generation of Continuous and Pulsed Diagnostic Imaging X-Ray Radiation Using a Carbon-Nanotube-Based Field-Emission Cathode", American Institute of Physics, Jul. 8, 2002, vol. 81, No. 2, pp. 355-357.

* cited by examiner

NANOSTRUCTURE BASED MICROFLUIDIC PUMPING APPARATUS, METHOD AND PRINTING DEVICE INCLUDING SAME

FIELD OF THE INVENTION

The present invention relates generally to printing devices, and more particularly to a microfluidic pump being suitable for ejecting fluid in a manner suitable for use in a drop-on-demand (DOD) inkjet printing device.

BACKGROUND OF THE INVENTION

In inkjet printing, the underlying principle is to convert a pulse of electric energy into a mechanical pressure pulse sufficient to overcome surface tension forces, holding fluid at a nozzle of a very small volume chamber. Generally, two technologies, piezoelectric and thermal actuators, have been utilized in inkjet printing.

One example of piezoelectric actuation of inkjet printheads is disclosed in U.S. Pat. No. 5,604,522, entitled "INK JET HEAD AND A METHOD OF MANUFACTURING THE INK JET HEAD", the entire disclosure of which is incorporated herein by reference, as if being set forth in its entirety. Therein is disclosed an ink jet head for forcibly discharging ink droplets through nozzle openings in a manner that a pressure of ink within an ink chamber is increased by displacing a vibrating plate constituting a part of the ink chamber by a piezoelectric transducer. The vibrating plate is formed of a high polymeric resin thin film and rigid protrusions resin directly fastened to the high polymeric resin thin film. With such a construction, an expanding/contracting motion of the piezoelectric transducer is transferred to the ink chamber, enlarging a minute contact area of the piezoelectric transducer and amplifying the pushing force to the ink chamber. However, it may be desirable to exert higher pressures on ink chambers than may conventionally be achievable using piezoelectric actuators. Further, disadvantages of piezoelectric based printing may also include the cost of manufacturing piezo materials, since the volume displacement of the ink is based on the shear deflection of piezo itself, and this displacement is limited by the size of the piezo.

In a thermally actuated inkjet printhead, a resistor is conventionally pulsed to heat an adjacent sheath of ink within the ink chamber. Boiling is forced to occur, typically within a few microseconds, by heating a film of water-based fluid to ~300° C., or nearly three times its normal boiling temperature. While this may result in an actuator that is many times smaller than typical piezoelectric transducer for the same job (i.e., for the same drop volume and velocity), it may impart an undesirable temperature fluctuation to the ink for example. A disadvantage of a thermal inkjet actuator may be its limited number of cycles though, as the number of working cycle times of thermal inkjet may be significantly less than that of a piezoelectric actuator.

SUMMARY OF THE INVENTION

In accordance with an aspect of the present invention, a microfluidic actuator suitable for effecting drop on demand inkjet printing by ejecting fluid through at least one nozzle from at least one cavity being at least partially formed by a deflectable membrane, the actuator including: an actuator chamber operatively coupled to the membrane and containing at least on electrolytic fluid; and, at least one nanostructure contained in the electrolytic fluid; and, wherein, the nanostructure is adapted to deflect toward the membrane in response to an operating voltage being applied to at least the nanostructure thereby deflecting the membrane and causing the fluid to be ejected through the nozzle.

In accordance with another aspect of the invention, a microfluidic pumping device suitable for effecting inkjet printing by ejecting fluid through at least one nozzle in response to activation of a deflectable membrane, the device including: an actuator operatively coupled to the membrane and containing at least one electrolytic fluid; and, at least one nanostructure contained in the electrolytic fluid; wherein, the nanostructure is adapted to deflect toward the membrane in response to an operating voltage being applied to at least the nanostructure thereby deflecting the membrane and causing the fluid to be ejected through the nozzle.

In accordance with another aspect of the invention, a microfluidic pumping device suitable for effecting inkjet printing by ejecting fluid through at least one nozzle in response to activation of a deflectable membrane, the device including: an actuator operatively coupled to the membrane; at least one nanostructure contained in the actuator; and, means for forming a double layer charge when an operating voltage is applied to the at least one nanostructure; wherein, the nanostructure is adapted to deflect toward the membrane in response to the double layer charge thereby deflecting the membrane and causing the fluid to be ejected through the nozzle.

In accordance with another aspect of the present invention, a method for effecting inkjet printing by ejecting fluid through at least one nozzle in response to activation of a deflectable membrane, the method including the step of applying a sufficient voltage to form a double layer charge on at least one nanostructure sufficient to cause enough deformation of the at least one nanostructure to deflect the membrane thereby ejecting the fluid through the nozzle.

In accordance with another aspect of the present invention, a device being suitable for printing a predetermined image on a substrate, the device including an array of inkjet nozzles suitable for applying ink to the substrate in the predetermined pattern, wherein each of the nozzles has associated therewith: at least one deflectable membrane; an actuator operatively coupled to the membrane and containing at least one electrolytic material; and, at least one nanostructure electrically coupled to the electrolytic material; wherein, the nanostructure is adapted to deflect in response to an operating voltage being applied to at least the nanostructure thereby deflecting the membrane and causing the ink to be ejected through the associated nozzle.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts.

DETAILED DESCRIPTION OF THE PREFERRED EMBODIMENTS

Figure 1:
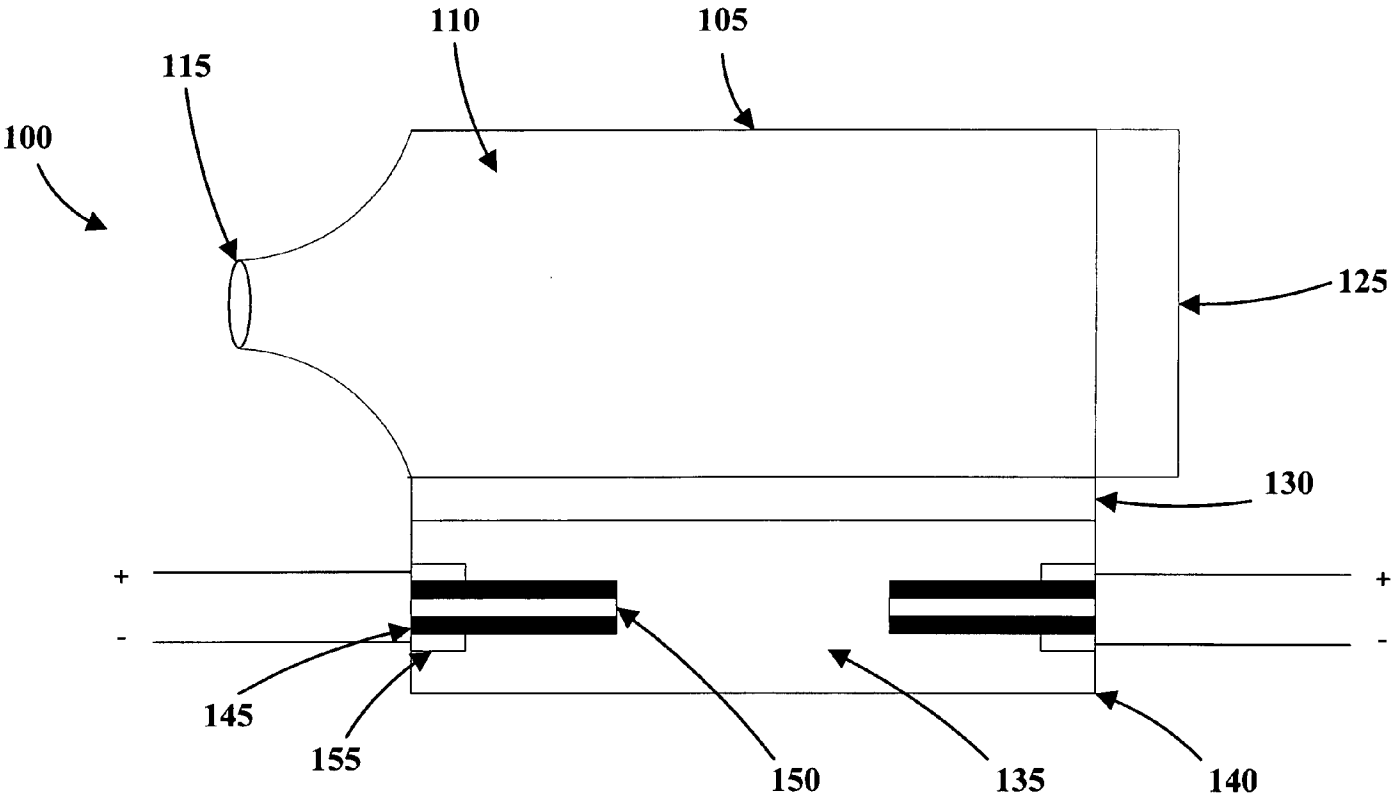
FIG. 1 illustrates a printing apparatus incorporating a microfluidic pump actuator according to an aspect of the present invention.

FIG. 1 illustrates a printing apparatus 100 incorporating a microfluidic pump actuator according to an aspect of the present invention. Apparatus 100 generally includes fluid cavity 105, nozzle 115, membrane 130 and actuation chamber 140.

Apparatus 100 may take the form of an inkjet printhead, suitable for being incorporated into conventional printing devices such as printers, copiers and facsimile machines. For example, such devices may include a plurality of apparatuses 100. Apparatus 100 may also take the form of any other device for which small, controlled amounts of substance ejection is desirable.

Nozzle 115 and membrane 130 may at least partially define cavity 105. The remainder of cavity 105 may be formed in a conventional manner. Cavity 105 may be configured so as to allow fluid 110 residing within cavity 105 to be contained by surface tension of fluid 110 at nozzle 115. Additionally, cavity 105 may be fluidically coupled to a fluid supply 125, such as by being fluidically communicable with a fluid reservoir or supply 125 via microchannels in which capillary forces assist in pulling ink from supply 125 into cavity 105.

Fluid 110 contained in cavity 105 may be any suitable material. Selection of fluid 110 may be based upon printing characteristics, viscosity, compressibility or surface tension, including colloidal solutions, for example. Fluid 110 may take the form of other materials such as vapors, for example. The critical feature largely being that it may be retained at nozzle 115, yet ejected responsively to membrane displacement as will be discussed. Fluid 110 may take the form of ink or other writing fluid suitable for use in printing technology. For example, fluid 110 may take the form of conventional piezoelectric displacement based inkjet ink. By way of further example, in the case of multiple apparatus 100 being incorporated into a color printing device, each apparatus 100 may contain ink of one of a plurality of predefined colors.

Nozzle 115 may take the form of any suitable nozzle, orifice or opening for ejecting fluid in a desired manner, such as a conventional inkjet nozzle. Further, nozzle 115 may take the form of multiple nozzles, orifices and/or openings for ejecting fluid in a desired manner.

Membrane 130 may simultaneously define a portion of cavity 105 and chamber 140. Membrane 130 may be made of any material suitable for communicating a pressure created within chamber 140 to cavity 105 by deformation. For example, membrane 130 may take the form of a polymeric resin membrane or steel membrane.

As will be understood by those possessing an ordinary skill in the pertinent arts, the exact characteristics of membrane 130, including material selection, deformability, elasticity, surface area and thickness for example, may depend on a number of well understood design criteria, including by way of example only, the volume of cavity 105, a desired amount of ink 110 to be ejected in response to activation of apparatus 100, the nature of ink 110, the nature of cavity 140 and the fluidic communicability with supply 125. For example, fluid contained within cavity 105 and/or chamber 140 may be corrosive in nature, such that membrane 130 should be designed not to prematurely corrode and fail. For example, membrane 130 may be Teflon coated. The chamber may be made of many types of materials that include ceramic, silicon, glass, metals such as steel, and polymer based structures made by molding techniques or etching, by way of non-limiting example only. The membrane may preferably be flexible, strong and have high cycle life, and be formed largely of candidate materials that include polymers and thin metals, by way of non-limiting example only.

Actuation chamber 140 may contain an electrolytic material, such as an electrolytic solution or solid 135, a plurality of nanostructures 145 arranged about insulators 150, and having electrodes 155 conductively coupled thereto. For example, multiple layers of nanostructures 145 separated by an insulator 150 may be provided. Chamber 140 may also provide electrical connectors for providing electrical connectivity to electrodes 155. Additionally, chamber 140, or one or more surfaces thereof may be suitable for growing, retaining, protecting or otherwise accommodating the presence of nanostructures 145. Chamber 140 may be designed or configured to maintain ions in electrolytic material 135. Chamber 140 may be at least partially defined by membrane 130.

Electrolytic material 135 may take the form of any suitable material for providing an electrolytic action. Electrolytic material 135 may be a nonmetallic electric conductor in which current is carried by the movement of ions in an aqueous solution capable of conducting electricity. Electrolytic material 135 may include an electrolyte capable of creating a double layer charge adjacent to nanostructures 145 as will be discussed. Electrolytic material 135 may take the form of an NaCl, $MgCl_2$, NaOH, $LiNO_3$, and $Al_2(SO_4)_3$ solution for example. Electrolytic material 135 may be referred to as an electrolytic solution 135 herein for sake of non-limiting explanation only. Further, it should be understood that alternative methods for creating a double charge may be used. For example, doping nanostructures 145 with positive and negative charges may be used. Nanostructures 145 may be doped using hydrogen or fluorine as is understood in the pertinent arts, for example. Electrodes 155 may take the form of any suitable electrodes for providing a voltage differential there-across, such as a conducting metal like copper.

Electrodes 155 may take the form of a conductor used to establish electrical contact with nanostructures 145. Insulators 150 may be made of an electrically insulating material and may be used for separating or supporting nanostructures 145 and electrodes 155, such as a Teflon coated material for example.

Nanostructures 145 may serve to convert electrical energy provided to electrodes 155 to mechanical energy suitable for generating stresses on membrane 130 when in the presence of electrolytic solution 135. Nanostructures 145 may take the form of carbon-based nanotubes, such as single-wall carbon nanotubes. Carbon nanotubes are a variant of crystalline carbon, and are structurally related to cagelike, hollow molecules composed of hexagonal and pentagonal groups of carbon atoms, or carbon fullerene "buckyballs", or $C_{60}$. It should be understood though, that while carbon fullerenes and nanotubes have many common features, there are differences in both structure and properties. Single-wall carbon nanotubes may have diameters of 1.2 to 1.4 nm, for example, with lengths of approximately 10 $\mu$m, for example. It should be understood however, that any nanostructure, or group of nanostructures (being either homogenous or heterogeneous in nature), such as multi-wall carbon nanotubes or arrays of single- and multi-wall carbon nanotubes, being suitable for deforming membrane 130 may be used though.

Nanostructures 145 may take the form of one or more films of single wall nanotubes, such as is described by Baughman et. al. in Carbon Nanotube Actuators. *Science, vol.* 284, pgs. 1340–1344, May 21, 1999. The manufacture of such films is understood by those possessing an ordinary skill in the pertinent art. Briefly, such films may take the form of sheets composed of mats of nanotube bundles joined by mechanical entanglement and van der Waals forces along incidental points and lines of contact as is taught by Baughman et. al. As described by Baughman et. al., commercially available nanotubes that are formed by dual-pulsed laser vaporization method and purified by a method using nitric acid redux, cycles of washing and centrifugation, and cross-flow filtration may be used. A film may be formed by a vacuum filtration of a nanotube suspension on a poly (terafluorethlyne) filter. Such films of nanotubes may be adhered to insulating material 150 such that the insulating material 150 is interposed between operatively cooperating groups of nanotubes. For example, such nanostructures may be adhered to the insulting material and the combined structure held at one end by the electrodes 155. An opposite end of the combined structure may deflect so as to push on the membrane separating the actuator chamber from the fluid cavity 110. Electrodes 155 may be attached to the combined nanostructure and insulator structure by a number of methods including use of conductive adhesives.

Nanostructures 145 may be provided in the form of "bucky paper" made of mats of carbon nanotubes in a film as described by Ray Baughman et al in "Carbon Nanotube Actuators", Science pp.1340–1344 Vol 284, May 1999. Such mats may be made by purification of commercially available tubes via nitric acid reflux, centrifugation, and cross-flow filtration. The nanotube suspension may be vacuum filtered and the dried sheets pulled from the filter. For example, such bucky paper may take the form of a thin mat of ropes or bundles of nanostructures, like single walled nanotubes. Included nanotubes may be of varying or common lengths, diameters and/or molecular structures and may consist largely of individual nanotubes, bundles or ropes of nanotubes, or combinations thereof.

As discussed by Baughman et. al., actuation of nanostructures 145 may be premised in quantum-based expansion due to electrochemical double-layer charging. By changing a voltage applied on electrodes 155, charge may be injected into nanostructures 145. This charge may be compensated at the charged nanostructure 145/electrolytic material 135 interface by electrolytic ions. This may form a double layer charge. This double layer charge may cause a dimensional displacement of the charged nanotubes from quantum chemical and electrostatic effects.

Nanotubes 145' may be homogeneous and poled in relation to an actuating electric field as to deflect in a direct perpendicular mode or cantilever mode when the electric field is applied to the faces thereof.

For example, and referring still to FIG. 1, a voltage differential, such as approximately one volt, may be applied on electrodes 155 as is shown therein (with a more positive potential being provided on an electrode physically nearer to membrane 130 than on an operatively cooperating electrode 155 more distal to membrane 130). Nanotubes 145 having a relatively positive charge injected thereinto will have a different change in length as opposed to nanotubes 145 having a relatively negative charge injected thereinto, resulting in a cantilever based displacement of nanotubes 145 towards membrane 130.

By reversing the applied voltage, such as by applying approximately one volt to electrodes 155 such that a more negative potential is provided on an electrode physically distal to membrane 130 than on an operatively cooperating electrode 155 being physically nearer to membrane 130) a relatively opposite physical force may be created. Nanotubes 145 having a relatively positive charge injected thereinto will again have a different change in length as opposed to nanotubes 145 having a relatively negative charge injected thereinto, resulting in a cantilever based displacement of nanotubes 145 away from membrane 130.

Figure 2A:
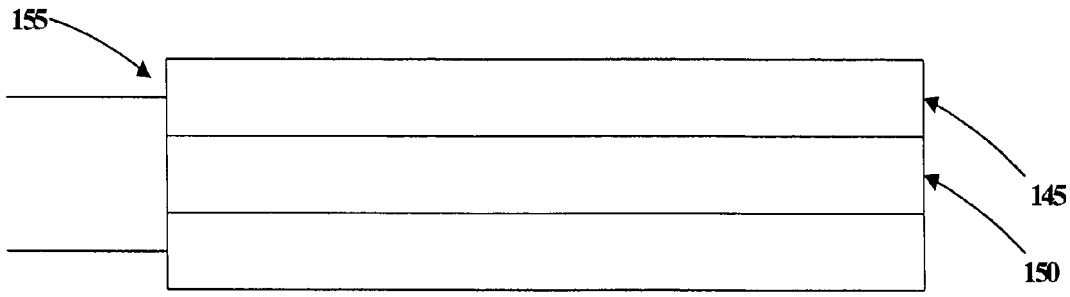
FIG. 2 illustrates actuation of nanostructures being suitable for use with the apparatus of FIG. 1; and, FIG. 3 illustrates exemplary input signals suitable for use with the apparatus of FIG. 1.
Figure 2B:
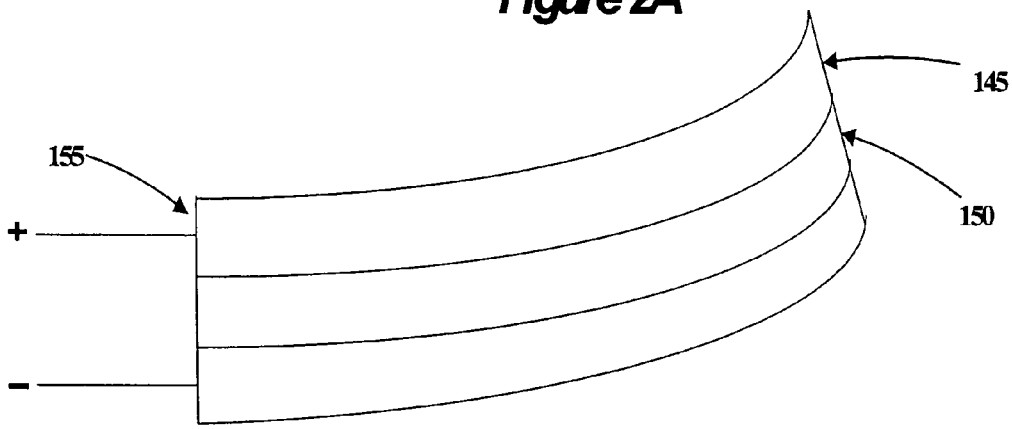

Referring now also to FIGS. 2A and 2B, there are shown exploded views of a plurality of nanotubes 145' supported by insulator 155 suitable for use with the apparatus of FIG. 1. Nanotubes 145' are suitable for use as nanostructures 145 (FIG. 1) and are disposed with insulator 150 located there between. Nanotubes 145' may be immersed within electrolytic solution 135 (FIG. 1) as has been set forth.

As may be seen in FIG. 2A, a first mode of operation 210 is shown. This first mode may correspond to a non-powered, at rest, first electrochemical actuation of membrane 130 (FIG. 1). As may be seen in FIG. 2B, a second mode of operation 220 is shown. This second mode may correspond to a powered, second electrochemical actuation of membrane 130 (FIG. 1). As shown in FIG. 2B, and as discussed hereinabove, when a voltage is applied across electrodes 150 (FIG. 1), and a corresponding electric field results, nanotubes 145' displace or deflect accordingly. This displacement, or deflection, may be suitable for deflecting membrane 130 (FIG. 1) so as to induce a pressure change within cavity 105 (FIG. 1) that overcomes the surface tension at nozzle 115, thus causing at least one droplet of fluid 110 to be expelled there-through.

In other words, as a signal applied to electrodes 155 is varied, electrodes 155 transmit a corresponding signal change to at least one of nanotubes 145'. As described above, a corresponding deflection of membrane 130 results. The surface tension of fluid 110 (FIG. 1) at nozzle 115 (FIG. 1) may be overcome by an increase in pressure on chamber 105 resulting from deflection of membrane 130 in response to deflection of nanotubes 145'. Signals applied to electrodes 155 may take any suitable form, such as a simple electrical pulse applied at a time corresponding to a desired drop time for ink 110 (FIG. 1).

Generally, a controller (not shown) for selectively activating electrodes 155 may be used. Such a controller may take any suitable form for driving operation of apparatus 100 (FIG. 1) or an array of apparatuses 100. For example, such a controller may take the form of suitable hardware, software, suitable microprocessor based device, Application Specific Integrated Circuit (ASIC) and/or combination thereof operatively coupled to electrodes 155 so as to cause operation thereof. Such a controller may be interconnected between a power supply and electrodes 155 of a particular apparatus 100 (FIG. 1) to cause selective deformation of nanotubes 145' thereby causing a selective increase in pressure in cavity 105 (FIG. 1) and causing the expulsion of ink through nozzle 115 on demand. Such a controller may serve to address an array of apparatuses 100 in a matrix fashion responsively to received information being indicative of pattern to be formed on a substrate, such as a sheet of paper, by selectively activating ones of the apparatuses 100 (FIG. 1) making up the array and thereby selectively dropping ink on demand.

Figure 3:
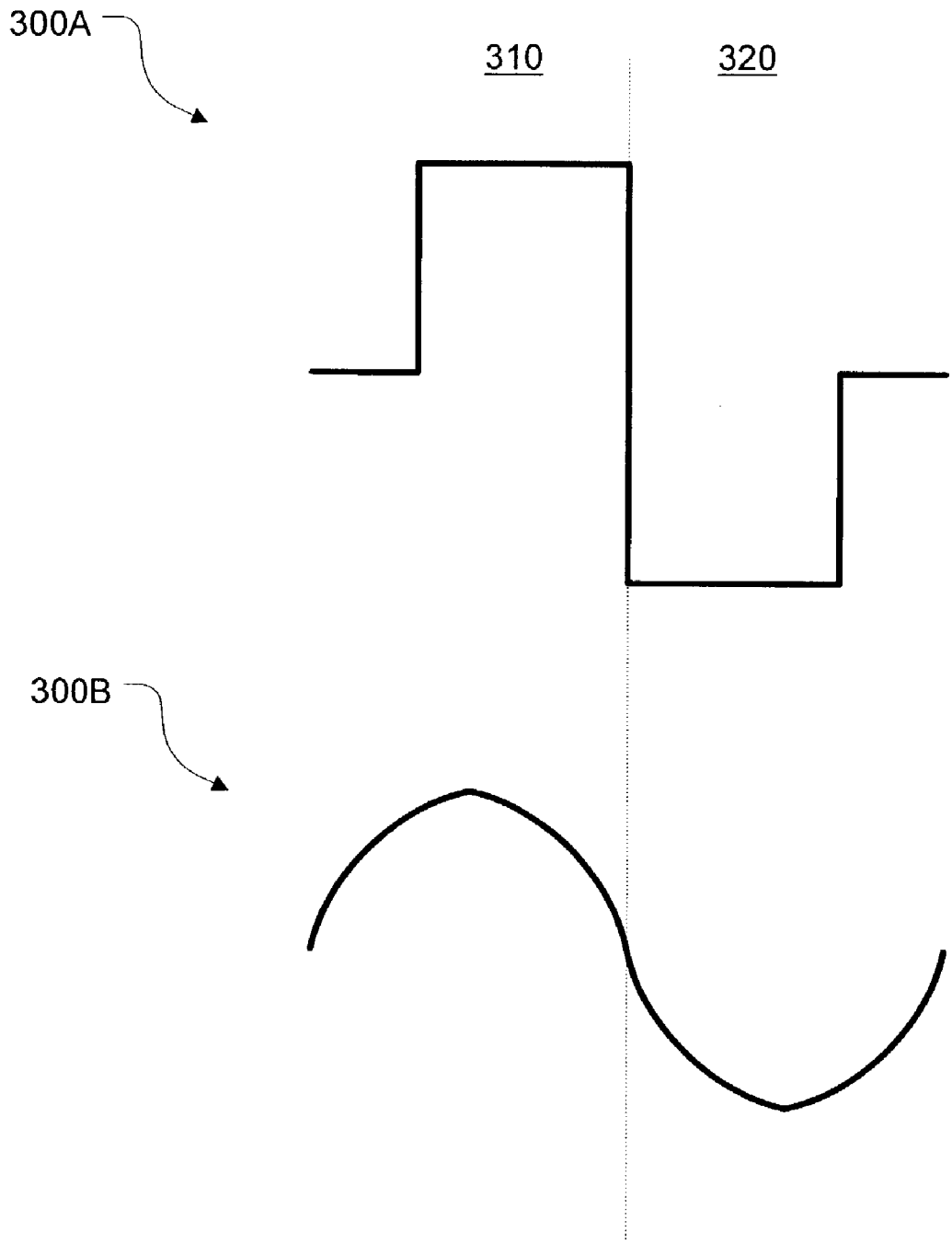

Referring now also to FIG. 3, there are shown exemplary input signals suitable for use with the apparatus of FIG. 1. In a first mode 310, a signal 300A, 300B may be applied to electrodes 155. In response thereto, nanotubes 145' on the two sides of a non-conductive material 150, immersed within electrolytic solution 135, elongate and bend toward membrane 130. This bending exerts a force on membrane 130 thereby causing a displacement in membrane 130. This displacement creates a volume displacement of fluid 110 within cavity 105 overcoming the surface tension of fluid 110 causing an ejection of a droplet 120 out of nozzle 115. As will be recognized by those possessing an ordinary skill in the pertinent art, some fluid may be caused to recede back through microchannels to reservoir 125 as well. This first mode 310 may correspond to the second mode 220 of FIG. 2.

Referring still to FIG. 3, in a second mode, signals 300A and 300B are again applied to electrodes 155. In response thereto, nanotubes 145' on the two sides of a non-conductive material 150, immersed within electrolytic solution 135, elongate and bend away from membrane 130. This causes the pressure inside cavity 105 to decrease allowing 125 fluid supply to refill reservoir 105 thereby stabilizing pressure within cavity 105. This second mode 320 may correspond to the first mode 210 (FIG. 2). As set forth, the fluid supply may refill the reservoir by capillary forces or other known available means. The returning action of nanotubes 145' may help to assist in resupplying cavity 105.

As will be evident to those possessing an ordinary skill in the pertinent arts, the present invention is not limited to drop on demand inkjet printing. Rather, a microfluidic actuator, or pump including such an actuator has broader application. By way of non-limiting example only, it may further be used in fluid systems on a chip as is used in the bio-sciences and chemical science industries to name a few.

It is to be understood that the figures and descriptions of the present invention have been simplified to illustrate elements that are relevant for a clear understanding of the present invention, while eliminating, for the purpose of clarity, many other elements found in typical printing and microfluidic actuation components and methods of manufacturing the same. Those of ordinary skill in the art will recognize that other elements and/or steps are desirable and/or required in implementing the present invention. However, because such elements and steps are well known in the art, and because they do not facilitate a better understanding of the present invention, a discussion of such elements and steps has not been provided herein.

Those of ordinary skill in the art will recognize that many modifications and variations of the present invention may be implemented without departing from the spirit or scope of the invention. Thus, it is intended that the present invention covers the modifications and variations of this invention provided they come within the scope of the appended claims and their equivalents.

What is claimed is:

1. A microfluidic pumping device suitable for effecting inkjet printing by ejecting fluid through at least one nozzle in response to activation of a deflectable membrane, said device comprising:

an actuator operatively coupled to said membrane and containing at least one electrolytic fluid; and, at least one nanostructure contained in said electrolytic fluid;

wherein, said nanostructure is adapted to deflect toward said membrane in response to an operating voltage being applied to at least said nanostructure thereby deflecting said membrane and causing said fluid to be ejected through said nozzle.

2. The device of claim 1, wherein said actuator forms an actuator chamber containing said electrolytic fluid.

3. The device of claim 1, wherein said nozzle partially forms a cavity with at least one opening.

4. The device of claim 1, wherein said nozzle comprises a plurality of nozzles.

5. The device of claim 4, wherein said actuator forms a plurality of actuator chambers each associated with a corresponding one of said plurality of nozzles.

6. The device of claim 1, wherein said fluid has a surface tension across said nozzle substantially restricting flow of said fluid through said nozzle except in response to deflection of said membrane.

7. The device of claim 1, wherein said fluid comprises ink.

8. The device of claim 1, wherein said fluid comprises a colloidal solution.

9. The device of claim 1, wherein said membrane comprises steel.

10. The device of claim 1, wherein said membrane comprises at least one polymeric material.

11. The device of claim 1, wherein said membrane is coated with a poly(terafluoroethylene) material.

12. The device of claim 1, wherein said electrolytic fluid comprises an electrolytic solution.

13. The device of claim 12, wherein said electrolytic solution comprises at least one material selected from the group consisting of NaCl, $MgCl_2$, NaOH, $LiNO_3$, and $Al_2(SO_4)^3$.

14. The device of claim 1, further comprising at least one electrode being electrically coupled to at least one corresponding nanostructure.

15. The device of claim 14, further comprising at least one controller operatively coupled to each said electrode for selectively providing a voltage thereon being suitable for at least partially effecting said nanostructure deflection.

16. The device of claim 1, wherein said at least one nanostructure comprises a plurality of carbon nanotubes having at least one substantially non-conductive material interposed there between.

17. The device of claim 16, wherein said at least one substantially non-conductive material comprises a Teflon coated material.

18. The device of claim 1, wherein said at least one nanostructure comprises at least one film of carbon nanotubes.

19. The device of claim 1, wherein said at least one nanostructure comprises at least two films of carbon nanotubes having at least one substantially non-conductive material interposed there between.

20. The device of claim 1, wherein said at least one nanostructure comprises at least one self-oriented array of carbon nanotubes.

21. The device of claim 1, wherein said at least on nanostructure comprises a plurality of single wall carbon nanotubes.

22. The device of claim 1, wherein said electrolytic fluid comprises an ionic compound.

23. The device of claim 22, wherein said ionic compound is water soluble.

24. The device of claim 1, wherein said deflection of said at least one nanostructure is at least partially dependent upon quantum based effects.

25. The device of claim 1, wherein said deflection of said at least one nanostructure is at least partially dependent upon electrostatic effects.

26. A microfluidic pumping device suitable for effecting inkjet printing by ejecting fluid through at least one nozzle in response to activation of a deflectable membrane, said device comprising:

an actuator operatively coupled to said membrane;

at least one nanostructure contained in said actuator; and, means for forming a double layer charge when an operating voltage is applied to said at least one nanostructure;

wherein, said nanostructure is adapted to deflect toward said membrane in response to said double layer charge thereby deflecting said membrane and causing said fluid to be ejected through said nozzle.

27. The device of claim 26, wherein said means for forming a double layer charge comprises doping of said at least one nanostructure.

28. The device of claim 26, wherein said actuator forms at least one actuator chamber.

29. The device of claim 26, wherein said wherein said nozzle partially forms a cavity having at least one opening.

30. The device of claim 26, wherein said nozzles comprises a plurality of nozzles.

31. The device of claim 26, wherein said actuator forms a plurality of actuator chambers each associated with a corresponding one of said plurality of nozzles.

32. The device of claim 26, wherein said fluid has a surface tension across said nozzle substantially restricting flow of said fluid through said nozzle except in response to deflection of said membrane.

33. The device of claim 26, wherein said fluid comprises ink.

34. The device of claim 26, wherein said fluid comprises a colloidal solution.

35. The device of claim 26, wherein said membrane comprises steel.

36. The device of claim 26, wherein said membrane comprises at least one polymeric material.

37. The device of claim 26, wherein said membrane is coated with a poly(terafluoroethylene) material.

38. The device of claim 26, wherein said means for forming a double layer charge comprises at least one electrolytic solution.

39. The device of claim 38, wherein said electrolytic solution comprises at least one material selected from the group consisting of NaCl, $MgCl_2$, NaOH, $LiNO_3$, and $Al_2(SO_4)^3$.

40. The device of claim 26, further comprising at least one electrode each being electrically coupled to at least one corresponding nanostructure.

41. The device of claim 40, further comprising at least one controller operatively coupled to each said electrode for selectively providing a voltage thereon being suitable for at least partially effecting said nanostructure deflection.

42. The device of claim 26, wherein said at least one nanostructure comprises a plurality of carbon nanotubes having at least one substantially non- conductive material interposed there between.

43. The device of claim 42, wherein said at least one substantially non-conductive material comprises a Teflon coated material.

44. The device of claim 26, wherein said at least one nanostructure comprises at least one film of carbon nanotubes.

45. The device of claim 26, wherein said at least one nanostructure comprises at least two films of carbon nanotubes having at least one substantially non- conductive material interposed there between.

46. The device of claim 26, wherein said at least one nanostructure comprises at least one self-oriented array of carbon nanotubes.

47. The device of claim 26, wherein said at least one nanostructure comprises a plurality of single wall carbon nanotubes.

48. The device of claim 26, wherein said means for forming a double layer charge comprises an ionic compound.

49. The device of claim 48, wherein said ionic compound is water soluble.

50. The device of claim 26, wherein said deflection of said at least one nanostructure is at least partially dependent upon quantum based effects.

51. The device of claim 26, wherein said deflection of said at least one nanostructure is at least partially dependent upon electrostatic effects.

52. A method for effecting inkjet printing by ejecting fluid through at least one nozzle in response to activation of a deflectable membrane, said method comprising the step of applying a sufficient voltage to form a double layer charge on at least one nanostructure sufficient to cause enough deformation of said at least one nanostructure to deflect said membrane thereby ejecting said fluid through said nozzle.

53. A device being suitable for printing a predetermined image on a substrate, said device comprising an array of inkjet nozzles suitable for applying ink to said substrate in said predetermined pattern, wherein each of said nozzles has associated therewith:

at least one deflectable membrane;

an actuator operatively coupled to said membrane and containing at least one electrolytic material; and, at least one nanostructure electrically coupled to said electrolytic material;

wherein, said nanostructure is adapted to deflect in response to an operating voltage being applied to at least said nanostructure thereby deflecting said membrane and causing said ink to be ejected through said associated nozzle.

54. The device of claim 53, wherein said actuator forms an actuator chamber containing said electrolytic material.

55. The device of claim 54, wherein said actuator forms a plurality of actuator chambers each associated with a corresponding one of said plurality of nozzles.

56. The device of claim 53, wherein said fluid has a surface tension across said nozzle substantially restricting flow of said fluid through said nozzle except in response to deflection of said membrane.

57. The device of claim 53, wherein said membrane comprises at least one of steel, a polymeric material and a material coated with a poly(terafluoroethylene) material.

58. The device of claim 53, wherein said electrolytic material comprises at least one material selected from the group consisting essentially of NaCl, MgCl2, NaOH, LiNO3, and Al2(SO4)3.

59. The device of claim 53, further comprising at least one electrode being electrically coupled to at least one corresponding nanostructure.

60. The device of claim 59, further comprising at least one controller operatively coupled to each said electrode for selectively providing a voltage thereon being suitable for at least partially effecting said nanostructure deflection.

61. The device of claim 53, wherein said at least one nanostructure comprises a plurality of carbon nanotubes having at least one substantially non- conductive material interposed there between.

62. The device of claim 61, wherein said at least one substantially non-conductive material comprises a Teflon coated material.

63. The device of claim 53, wherein said at least one nanostructure comprises at least one film of carbon nanotubes.

64. The device of claim 53, wherein said at least one nanostructure comprises at least two films of carbon nanotubes having at least one substantially non- conductive material interposed there between.

65. The device of claim 53, wherein said at least one nanostructure comprises at least one self-oriented array of carbon nanotubes.

66. The device of claim 53, wherein said at least on nanostructure comprises a plurality of single wall carbon nanotubes.

67. The device of claim 66, wherein said electrolytic material comprises an ionic compound.

68. The device of claim 53, wherein said deflection of said at least one nanostructure is at least partially dependent upon quantum based effects.

69. The device of claim 53, wherein said deflection of said at least one nanostructure is at least partially dependent upon electrostatic effects.

* * * * *